United States Patent [19]

Förg

[11] 4,229,195

[45] Oct. 21, 1980

[54] METHOD FOR LIQUIFYING NATURAL GAS

[75] Inventor: Wolfgang G. Förg, Icking, Fed. Rep. of Germany

[73] Assignee: Linde Aktiengesellschaft, Hollriegelskreuth, Nr. Munich, Fed. Rep. of Germany

[21] Appl. No.: 35,706

[22] Filed: May 3, 1979

[30] Foreign Application Priority Data

May 9, 1978 [DE] Fed. Rep. of Germany ..... 2820212

[51] Int. Cl.[3] ..... F25J 3/02

[52] U.S. Cl. ..... 62/23; 62/40; 62/18

[58] Field of Search ..... 62/23, 40, 18, 54

[56] References Cited

U.S. PATENT DOCUMENTS

| | | | |
|---|---|---|---|
| 3,315,477 | 4/1967 | Carr | 62/40 |
| 3,360,944 | 1/1968 | Knapp et al. | 62/18 |
| 3,418,819 | 12/1968 | Grunberg et al. | 62/40 |
| 3,780,535 | 12/1973 | Darredeau | 62/40 |

*Primary Examiner*—Norman Yudkoff

[57] ABSTRACT

A method for liquefying natural gas comprises heat exchanging a pressurized natural gas with two independent coolant circuits. The first coolant circuit pre-cools the compressed natural gas. After the natural gas is pre-cooled in the first circuit, a major portion is liquefied in heat exchange with the coolant in the second circuit while the remaining minor portion is liquefied in heat exchange with the flash gas formed when the so liquefied natural gas is expanded. Subsequent to the flash gas being heat exchanged with the divided minor fraction of natural gas, it is compressed and then at least partly liquefied in heat exchange with the coolants in the first and second circuits and subsequently expanded in the separator containing said flash gas.

12 Claims, 2 Drawing Figures

METHOD FOR LIQUIFYING NATURAL GAS

FIELD OF THE INVENTION

This invention relates to a method for liquefying natural gas which includes the use of pre-cool and deep-cool circuits wherein the step of liquefying the natural gas, it is divided into two streams to provide a very favourable process from an energy conservation point of view.

BACKGROUND OF THE INVENTION

Gas liquefaction processes have involved splitting the natural gas feed, a minor portion of the split being heat exchanged with head product to liquefy such split off natural gas. An approach is disclosed in West German Offenlegungsschrift No. 24 38 443 in which natural gas rich in nitrogen is liquefied under pressure. The natural gas is expanded and is then passed to a rectifying column for the purpose of separating the nitrogen. The resulting head product from the column rich in nitrogen is heat exchanged with a partial flow of the natural gas to be liquefied. The head product is subsequently heated to ambient temperature in heat exchange with the total flow of natural gas and with the coolants in the pre-cool and deep-cool circuits. The head product is subsequently discharged from the liquefaction installation. Such discharge may be compressed and burned in gas turbines, for example, thus helping to cover the energy requirement of the liquefaction method.

The process according to this invention liquefies the natural gas in a more efficient energy conservation manner. This is principally achieved by compressing the flash gas after heat exchange with the pre-cooled split off portion of natural gas, at least partly liquefying the compressed flash gas in heat exchange with the first and second coolant circuits and subsequently expanding and rejoining the cooled compressed flash gas with the expanded deep-cooled liquefied natural gas.

SUMMARY OF THE INVENTION

The process according to this invention is highly advantageous from an energy conservation standpoint. This is due to a lesser refrigeration load requirement from the deep-cooling circuit in liquefying the natural gas by taking advantage of the flash gas to liquefy a minor portion of the pre-cooled feed, that is, natural gas liquefaction can take place at temperature level higher than that in known processes. When the liquefied natural gas is expanded, the amount of flash gas is larger than in known methods due to it being liquefied at a higher temperature where the cold from the produced flash gas is used to liquefy the split-off flow of pre-cooled natural gas. The flash gas is compressed and recycled through the liquefaction process. It has been found that if dimensions of the deep-cool circuit are appropriate, a matter which depends on the composition of the natural gas, the energy saved in the circuit exceeds the cost of recompressing the flash gas thus producing an overall more satisfactory energy balance. The method according to this invention is also satisfactory from the operational point of view because if it is carried out on a suitable scale the same compressor may be used in the first and second cooling circuits.

According to an aspect of the invention the method comprises heat exchanging a flow of pressurized natural gas with two cooling circuits. The first cooling circuit serves to pre-cool the flow of natural gas and to pre-cool the coolant in the second cooling circuit. The coolant in the second circuit after having been pre-cooled is used to liquefy a major portion of the pre-cooled natural gas. After pre-cooling the flow of pressurized natural gas it is divided into major/minor streams. The major stream is liquefied by the deep-cooled circuit and is expanded and separated in a separator. The flash gas formed from the expansion of the liquefied natural gas is withdrawn from the separator and heat exchanged with the minor portion of pre-cooled natural gas to liquefy such minor portion of natural gas. The liquefied minor portion is expanded and combined with the liquefied expanded major stream of natural gas. The flash gas is compressed after heat exchange with the pre-cooled natural gas and is at least partially liquefied in heat exchange with the coolants of the first and second circuits and is expanded and combined with the expanded liquefied natural gas in the separator.

DETAILED DESCRIPTION OF A PREFERRED EMBODIMENT OF THE INVENTION

Figure 1:
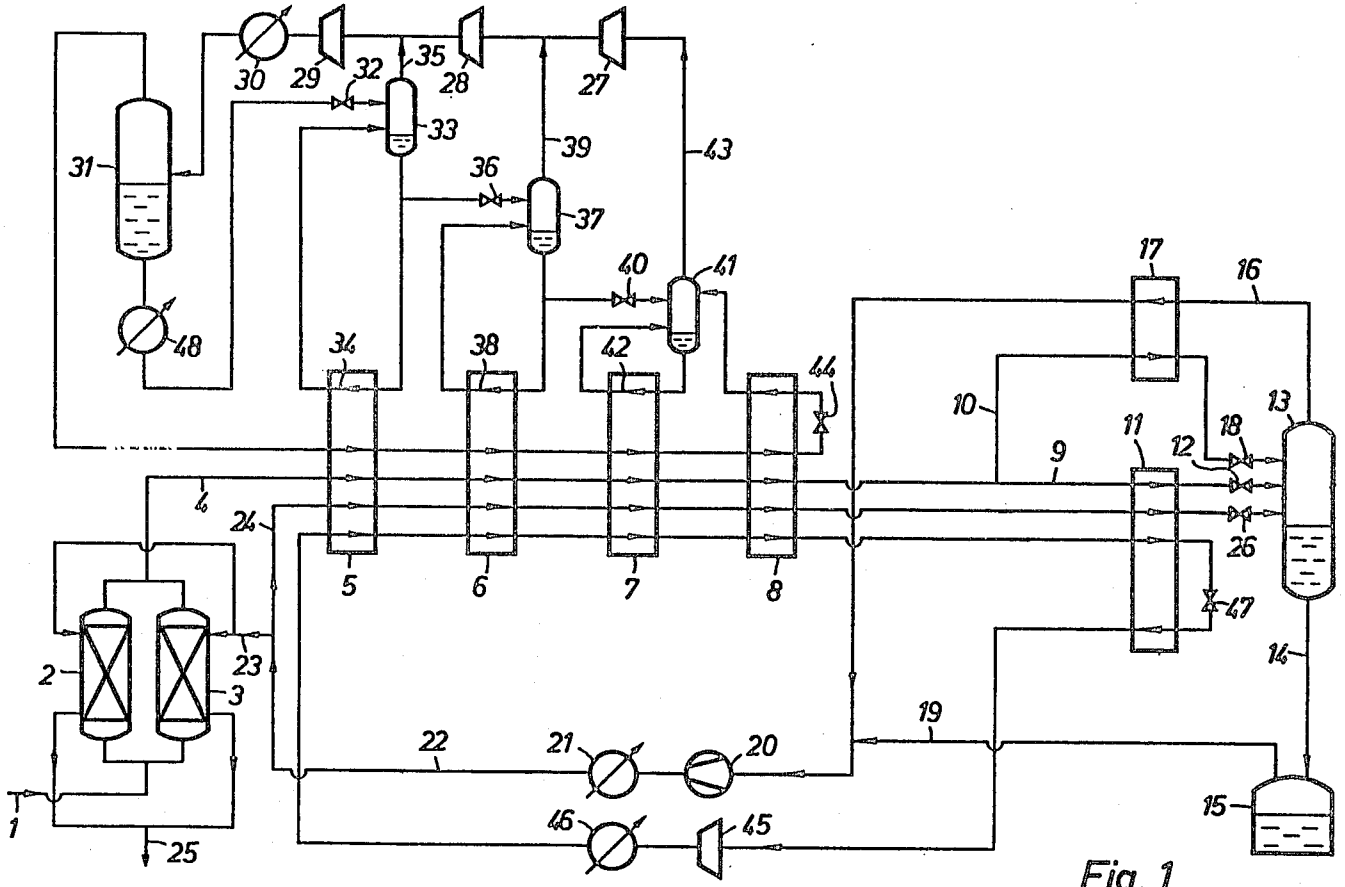
FIG. 1 is a schematic flow diagram showing various aspects of a preferred embodiment of the invention.

In FIG. 1, natural gas to be liquefied, consisting, in this embodiment mainly of methane and small amounts of ethane, propane and higher boiling hydrocarbons, and also containing small quantities of $CO_2$, $H_2O$ and nitrogen, is passed at ambient temperature through line 1, at a pressure of about 60 bars to the liquefaction installation. The natural gas is scrubbed of $H_2O$ and $CO_2$ in absorbers 2 and 3 which operate alternately. The adsorption medium in this case may be molecular screens. The scrubbed natural gas is passed through line 4 to heat-exchangers 5, 6, 7 and 8 of the pre-cooling circuit, where the natural gas is cooled to a temperature of about −50° C. If the natural gas is available at a sufficiently low temperature, for example a low ambient temperature, pre-cooling in heat exchanger 5 may be dispensed with.

After pre-cooling, the natural gas is divided into major and minor streams 9 and 10. The natural gas in major stream 9 is cooled in heat exchanger 11 to a temperature of about 120 K and is thus fully liquefied and supercooled. The liquefied natural gas is expanded in throttle valve 12 to a pressure slightly above atmospheric. The resulting flash-gas is separated from the liquid phase in separator 13. The liquid phase passes through line 14 to a storage container 15, while the flash-gas is removed through line 16. The flash gas is heat exchanged in heat exchanger 17 with minor stream 10 of the natural gas. Partial flow 10, is completely liquefied and supercooled in exchanger 17 and is expanded in throttle valve 18 and is also subjected to phase separation in separator 13.

The flash-gas heated in heat exchanger 17 is optionally combined with the "boil-off" gas flowing through line 19 from storage container 15. In this instance the so combined gases are compressed in turbo-compressor 20 to a pressure of about 35 bars. This heats the gas to a temperature above ambient temperature so the gas is cooled in after-cooler 21 to ambient temperature. The compressed gas in line 22 is divided into streams 23, 24. The partial flow branched off through line 23 passes through either adsorber 2 or 3 driven in the regenerating mode to regenerate the adsorbent charged with $H_2O$ and $CO_2$. It is then removed through line 25 and burned in a gas-turbine, not shown.

The other partial flow compressed flash gas is passed through line 24 to the pre-cooling stage, is again-pre-cooled in heat exchangers 5, 6, 7 and 8, and is passed to heat exchanger 11 in which it is completely liquefied and supercooled. The liquefied and supercooled compressed flash gas stream is expanded in throttle valve 26 into separator 13 in which a phase separation is carried out.

Respecting the two coolant circuits, it is desirable to use mixture of coolant components in each circuit. In the first pre-cool circuit, it is preferable to subject the coolant to phase separation in separator 31 after it is partially liquefied in after-cooler 30. The resulting liquid fraction is at least partially vapourized after expansion and heat exchange with the natural gas. The expansion of the liquid fraction may be carried out in a plurality of consecutive stages. The gaseous fraction from separator 31 is liquefied in heat exchange with the expanded liquid fractions and is then vapourized in heat exchange with the natural gas and with the second coolant which is at least partially liquefied during this heat exchange.

Such a configuration for the pre-cooled circuit is highly satisfactory from an energy point of view because the separate vapourizing of the fractions arising during the phase separation of the partly condensed coolant produces a heating curve for the coolant which is close to the cooling curve of the natural gas. Moreover, satisfactory temperature stabilization is achieved in the heat exchangers because the phase separation of the coolant at each stage of the pre-cool circuit vapourizes, in the respective heat exchangers, fluids heavily enriched with higher boiling point constituents of the coolant.

With respect to the pre-cool circuits a mixture of $C_2$ and $C_3$ hydrocarbons have been found satisfactory. The proportion of $C_2$ hydrocarbons being in the range of 5 to 20 mole percent. Preferably ethylene or ethane is suitable as the selected $C_2$ hydrocarbon. For the selected $C_3$ hydrocarbon, this may preferably be either propane or propylene. A mixture of 8 mole percent of ethylene and 92 mole percent of propane has been found particularly suitable for the composition of the pre-cool circuit.

In the second deep-cool circuit, mixtures of nitrogen, methane, $C_2$ and $C_3$ hydrocarbons have been found satisfactory. The nitrogen may amount to between 5 and 16 mole percent, the methane between 30 and 45 mole percent, the $C_2$ hydrocarbon between 30 and 50 mole percent and the $C_3$ hydrocarbon between 3 and 20 mole percent. Preferably a mixture containing 10 mole percent nitrogen, 31 mole percent methane, 45 mole percent ethylene and 16 mole percent propane is suitable for the deep-cool circuit composition.

The coolant in the pre-cool circuit is compressed to circuit pressure in stages 27, 28, 29 of the circuit compressor and is partly condensed in water-cooler 30. The partly condensed mixture is subjected to phase separation in separator 31. The liquid or fluid fraction in separator 31, heavily enriched in propane, is intermediately expanded, after further cooling in water-cooler 48 through a valve 32 into first separator 33. A part of the fluid fraction in separator 33, which is now made up substantially of propane is vapourized in cross section 34 of heat exchanger 5 and returned to separator 33. The formed vapour by vapourization along with the vapour produced by expansion is passed through line 35 to the third or final compressor stage 29.

The remainder of the fluid fraction in separator 33 is expanded through valve 36 into a second separator 37. Some of the fluid fraction in separator 37 is vapourized in cross section 38 of heat exchanger 6 and returned to separator 37. As in separator 33, the vapours are passed through a line 39 to the second compressor stage 38.

The remainder of the fluid fraction in separator 37 is expanded through a valve 40 into a third separator 41 to the lowest pressure in the circuit. The fluid fraction in separator 41 is vapourized in cross section 42 of heat exchanger 7 and returned to separator 41. The vapours are passed through a line 43 to first compressor stage 27.

The multi-stage expansion and vapourization, at various pressure levels, of the fluid fraction occurring in separator 31 is highly satisfactory from the energy point of view because it produces very good adaptation of the coolant heating curve to the natural gas cooling curve. The arrangement of separators 33, 37 and 41 prevents any unvapourized coolant from reaching the compressor stages, which might lead to destruction of the compressors. Another decisive advantage of the arrangement of separators 31, 33, 37 and 41 is that in spite of the use of coolants consisting of mixed components, the coolant is rich in propane which vapourizes in heat exchanger cross sections 34, 38 and 42. This is highly important from the point of view of temperature stabilization in heat exchangers 5, 6 and 7.

The gaseous fraction arising in separator 31 is liquefied and supercooled in heat exchangers 5, 6, 7 and 8 and is expanded in valve 44 and vapourized in relation to the natural gas flowing in lines 4 and 24 and the coolant in the second deep-cool circuit. It is then passed to separator 41 where the vapour combines with the other vapours and is passed through line 43 to the first compressor stage 27. The cooling of the vapour from separator 31 is optional in heat exchanger 8. In some instances, the cooled gaseous fraction (may be totally liquefied) is expanded in valve 44 after passing through exchanger 7.

Since the gaseous fraction arising in separator 31 consists of ethylene and propane, the temperature in heat exchanger 8 can be dropped to a relatively low temperature level. This makes it possible to liquefy in heat exchanger 8 a large part of the multi-component mixture in the deep-cool circuit. This is highly satisfactory from a thermodynamic point of view.

The coolant in the second circuit, in which cooling is provided for the complete liquefaction and supercooling of the natural gas, consists mainly of nitrogen, methane, ethylene and propane. It is compressed in circuit compressor 45 to circuit pressure preferably in the range of 40 to 65 atm and is cooled in water cooler 46. It is thereafter partly liquefied in heat exchangers 5, 6, 7 and 8 in heat exchange with the coolant in the first circuit. In heat exchanger 11, the mixture is completely liquefied and supercooled. It is expanded in valve 47 and vapourized in heat exchanger 11 in relation to the split off portion 9 of the natural gas to thereby liquefy and supercooled the natural gas in relation to the pre-cooled compressed flash gas in line 24 and in relation to itself. The vapourized coolant is passed to circuit compressor 45 to complete the cycle. The main advantage of the second circuit is its simplicity because all that is required to liquefy and supercool the natural gas is a single heat exchanger 11 with four cross sections, making it possible to use a coiled type of heat exchanger.

Figure 2:
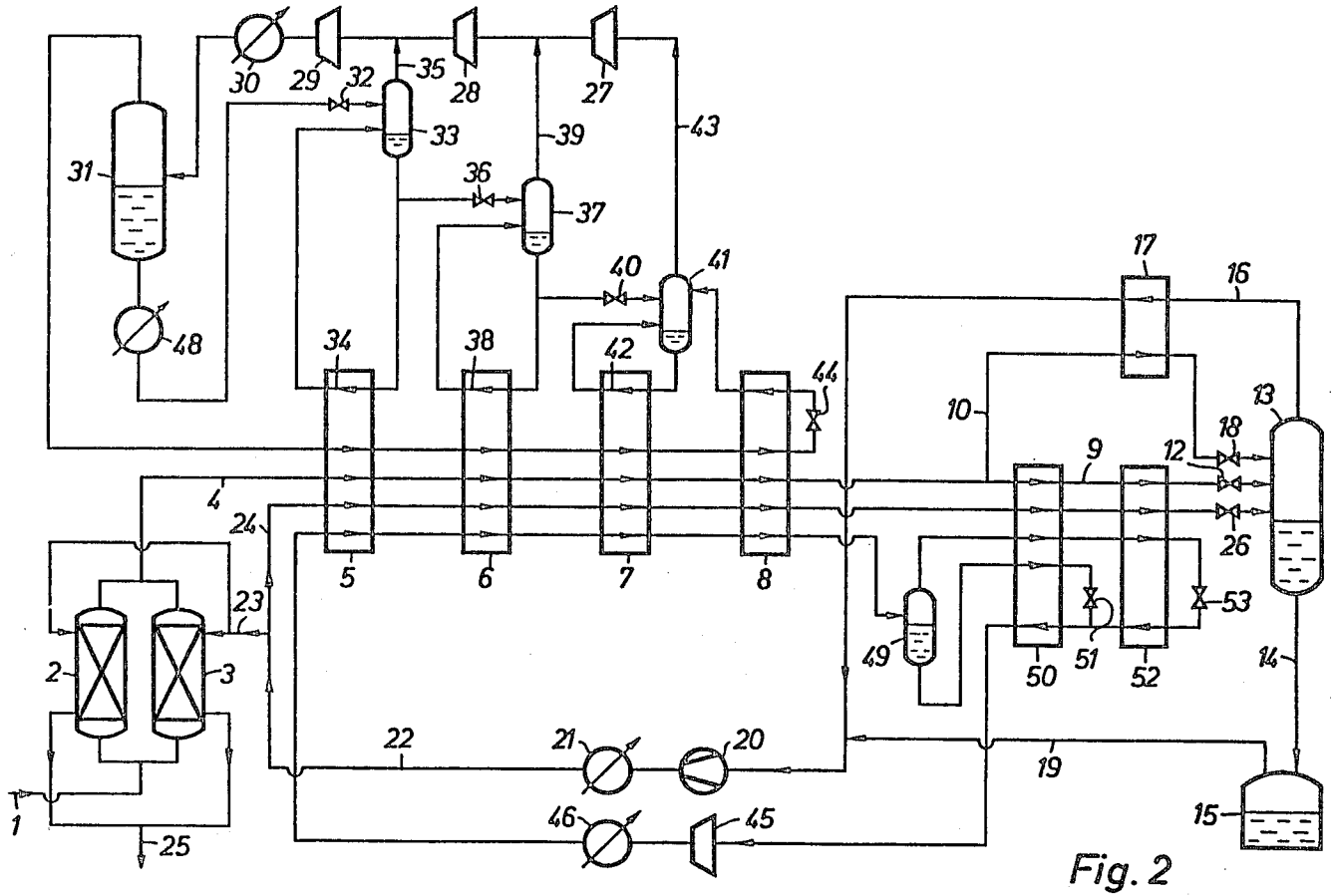
FIG. 2 is a schematic flow diagram showing various aspects of another preferred embodiment of the invention employing a variation in the deep-cool circuit of the process of FIG. 1.

The embodiment of the invention as shown in FIG. 2 relates to a feature in the deep-cooling circuit which improves its efficiency in liquefying the pre-cooled natural gas. The details of the pre-cool circuit remain the same as is apparent from the use of the identical numerals to identify identical parts on the flow sheet. In the deep-cool circuit, the multi-component coolant is partly condensed in heat exchangers 5, 6, 7 and 8. The pre-cooled coolant is subjected to phase separation in separator 49. The liquid fraction in separator 49 is supercooled in heat exchanger 50. The so cooled liquid fraction is expanded in valve 51 and vapourized in heat exchanger 50 relative to the natural gas being liquefied in lines 9 and 24, the gaseous fraction from separator 49 and itself.

The gaseous fraction from separator 49 is liquefied in heat exchanger 50 and is supercooled in heat exchanger 52, expanded in valve 53 and is vapourized in heat exchanger 52 relative to the natural gas geing supercooled and itself. The two fractions are then combined and returned to compressor 45 to complete the cycle.

Although various embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A method for liquefying natural gas, in which a flow of pressurized natural gas is brought into heat exchange with two coolants flowing in closed circuits which are at least partly compressed, liquefied and expanded, the coolant in the first circuit being used to pre-cool the natural gas and the coolant in the second circuit while the coolant in the second circuit is used to liquefy the pre-cooled natural gas; the coolants in said first and second circuits comprising multiple components, after pre-cooling the natural gas down to approximately −50° C., the natural gas is divided into major and minor streams, said major stream being liquefied by heat exchange with the coolant in the second circuit, while said minor stream being liquefied by heat exchange with the flash-gas formed when the liquefied natural gas is expanded and the liquid fraction separated, the flash-gas after heat exchange with said minor stream is compressed and is at least partly liquefied in heat exchange with the coolant in said first and second circuits, and is subsequently expanded and the liquid fraction separated.

2. A method according to claim 1, wherein before being brought into heat exchange with the coolant in the first circuit, the natural gas is cleaned adsorptively and the branched-off, partial flow of compressed flash-gas, used to produce energy, is used to regenerate the charged adsorbent.

3. A method according to claim 1 wherein the coolant in the first circuit is subjected, after partial liquefaction, to a phase separation; the thus produced liquid fraction, after being expanded, is at least partly vapourized in heat exchange with the flow of natural gas, with the gaseous fraction from said phase separation, and with the coolant in said second circuit, the gaseous fraction from said phase separation is liquefied in heat exchange with said expanded liquid fraction, and is expanded and at least partly vapourized in heat exchange with the natural gas and the coolant of said second circuit to thereby at least partly liqudfy such second coolant.

4. A method according to claim 3 wherein the coolant in the first circuit is compressed to a pressure of between 8 and 18 bars, the liquid fraction is expanded step-wise to about atmospheric pressure in three stages, and the gaseous fraction from said phase separation after being liquefied, is expanded to about atmospheric pressure.

5. A method of claim 3 wherein the coolant in said second circuit is subjected to phase separation after heat exchange with said first circuit, the so formed liquid fraction is further cooled, expanded and heat exchanged with said stream of natural gas, with said compressed-flash gas, and with itself in providing said further cooling thereof; the so formed gaseous fraction is liquefied in heat exchange with said further cooled expanded liquid fraction and further cooled, expanded and heat exchanged with said stream of natural gas, with said compressed flash-gas, and with itself in providing said further cooling thereof.

6. A method according to claim 1 wherein the coolant in the first circuit consists of between 5 and 20 mole percent of $C_2$ hydrocarbons and between 95 and 80 mole percent of $C_3$ hydrocarbons.

7. A method according to claim 6 wherein ethylene or ethane is used as the $C_2$ hydrocarbon, while propane or propylene is used as the $C_3$ hydrocarbon.

8. A method according to claim 1 wherein the coolant in the second circuit consists of a mixture of between 5 and 15 mole percent of nitrogen, between 30 and 45 mole percent of methane, between 30 and 50 mole percent of $C_2$ hydrocarbons, and between 3 and 20 mole percent of $C_3$ hydrocarbons.

9. A method according to claim 1 wherein the mixture used in the first circuit contains 8 mole percent of ethylene and 92 mole percent of propane, while that used in the second circuit contains 11 mole percent of nitrogen, 31 mole percent of methane, 42 mole percent of ethylene and 16 mole percent of propane.

10. A method according to claim 1 wherein the liquid phase of the compressed coolant in the first circuit is expanded in several stages, and a phase separation is carried out after each expansion stage, the liquid fraction thus produced being partly vapourized in heat exchange with the media to be cooled, while the liquid remainder passes to the next expansion stage.

11. A method according to claim 1 wherein the coolant in the second circuit is compressed to a pressure of between 40 and 65 bars, is expanded and then supercooled and is then expanded in a single stage to a pressure of between 1 and 5 bars.

12. A method of claim 1 wherein the coolant in said second circuit is subjected to phase separation after heat exchange with said first circuit, the so formed liquid fraction is further cooled, expanded and heat exchanged with said stream of natural gas, with said compressed flash-gas, and with itself in providing said further cooling thereof; the so formed gaseous fraction is liquefied in heat exchange with said further cooled expanded liquid fraction and further cooled, expanded and heat exchanged with said stream of natural gas, with said compressed flash-gas, and with itself in providing said further cooling thereof.

* * * * *